US005728979A

United States Patent [19]

Yazici et al.

[11] Patent Number: 5,728,979

[45] Date of Patent: Mar. 17, 1998

[54] AIR HANDLING STRUCTURE FOR FAN INLET AND OUTLET

[75] Inventors: Muammer Yazici, Etobicoke; Werner Richarz, Ottawa, both of Canada

[73] Assignee: Air Handling Engineering Ltd., Buffalo, N.Y.

[21] Appl. No.: 675,404

[22] Filed: Jul. 2, 1996

Related U.S. Application Data

[60] Continuation-in-part of Ser. No. 260,753, Jun. 16, 1994, Pat. No. 5,587,563, which is a division of Ser. No. 72,590, Jun. 4, 1993, Pat. No. 5,426,268.

[30] Foreign Application Priority Data

Apr. 5, 1993 [CA] Canada ..... 2093534

[51] Int. Cl.[6] ..... E04F 17/04

[52] U.S. Cl. ..... 181/224

[58] Field of Search ..... 181/217, 218, 181/224, 225, 258, 268, 270, 281, 282

[56] References Cited

U.S. PATENT DOCUMENTS

| | | | |
|---|---|---|---|
| 2,916,101 | 12/1959 | Naman . | |
| 2,994,401 | 8/1961 | Bourne et al. | 181/224 |
| 3,018,840 | 1/1962 | Bourne . | |
| 3,094,189 | 6/1963 | Dean . | |
| 3,511,336 | 5/1970 | Rink et al. | 181/224 |
| 4,287,962 | 9/1981 | Ingard . | |
| 4,295,416 | 10/1981 | Gorchev . | |
| 4,319,521 | 3/1982 | Gorchev . | |
| 4,418,788 | 12/1983 | Gorchev . | |
| 4,872,398 | 10/1989 | Shen | 181/224 X |
| 4,986,170 | 1/1991 | Ramakrishnan . | |

FOREIGN PATENT DOCUMENTS

| | | |
|---|---|---|
| 1133313 | 10/1982 | Canada . |
| 1317503 | 5/1993 | Canada . |
| 9017396 | 1/1992 | Germany . |
| 1423986 | 2/1976 | United Kingdom . |

*Primary Examiner*—Khanh Dang
*Attorney, Agent, or Firm*—Baker & Daniels

[57] ABSTRACT

Combined air duct apparatus and silencer for attachment to both the inlet and the outlet of a fan unit for a building wherein each silencing apparatus has an exterior housing with an air inlet and an air outlet, one of which is adapted for connection to the fan unit. The inlet and outlet are connected by an airflow passageway defined by interior walls of the housing. First and second series of splitters are also provided in the outlet duct unit. The splitters in each series are spaced apart to form smaller air passageways and mounted side-by-side in a row. In the outlet duct unit, the air inlet is circular or annular while the outlet is rectangular. In one embodiment, the outlet lies in a plane at a substantial angle to the plane of the annular inlet and the main airflow passageway is substantially curved in its lengthwise direction.

30 Claims, 9 Drawing Sheets

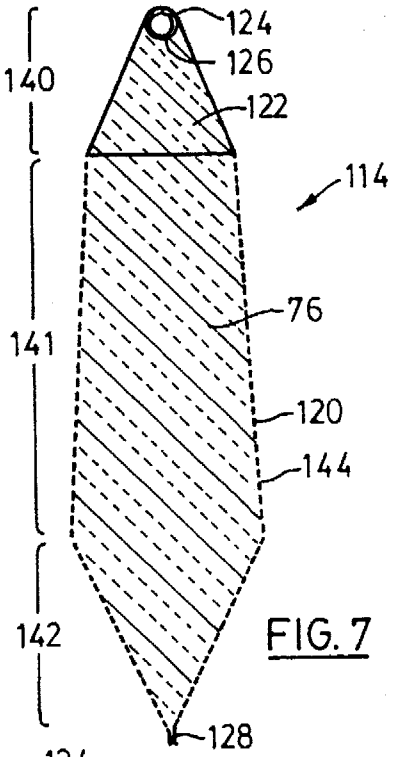
FIG. 7
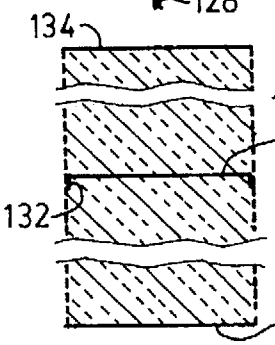
FIG. 8
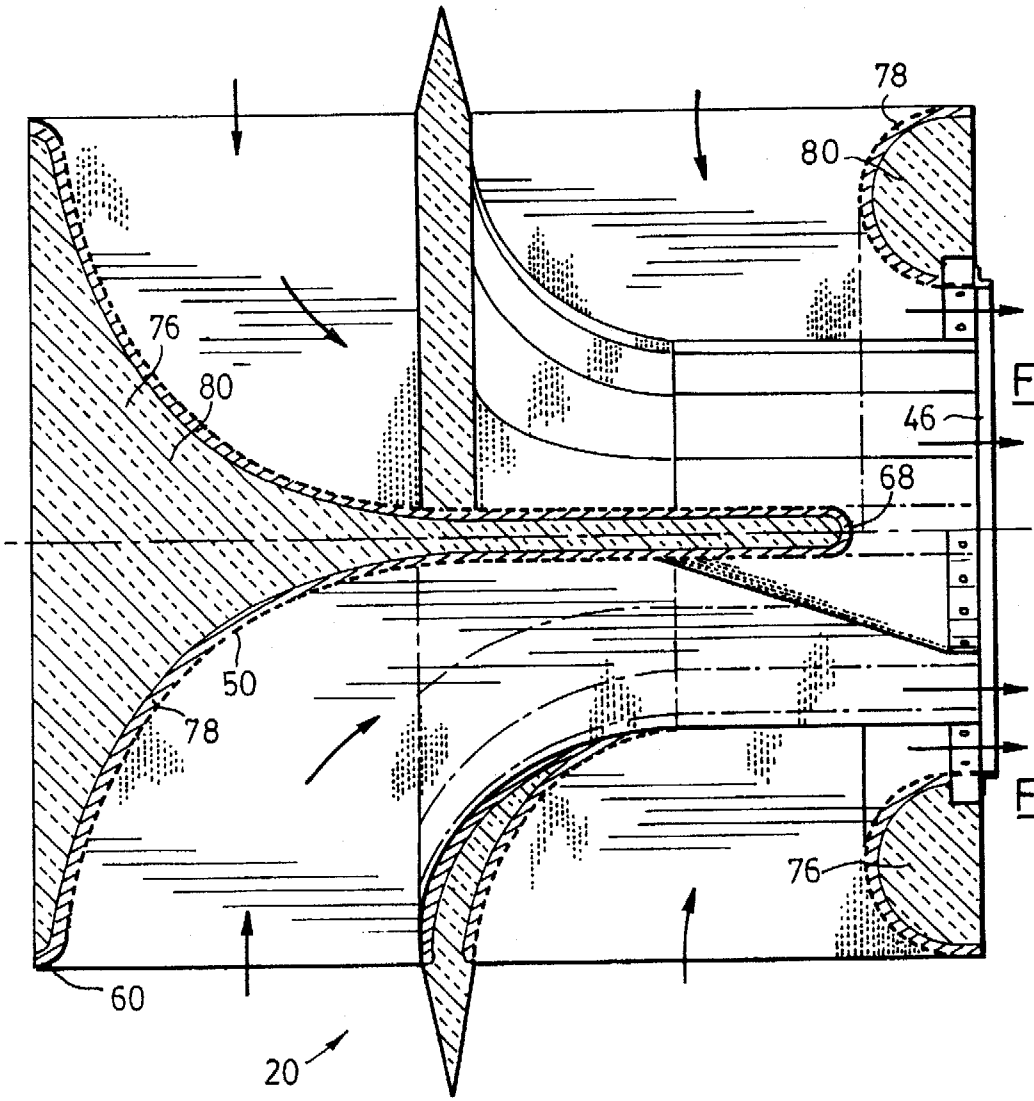

AIR HANDLING STRUCTURE FOR FAN INLET AND OUTLET

This application is a continuation-in-part of U.S. patent application Ser. No. 08/260,753 filed Jun. 16, 1994, now U.S. Pat. No. 5,587,563, which is a divisional of U.S. patent application Ser. No. 08/072,590 filed Jun. 4, 1993, now U.S. Pat. No. 5,426,268 issued Jun. 20, 1995.

BACKGROUND OF THE INVENTION

This invention relates to air duct apparatus for use in conjunction with air supply fan units, particularly such units designed for buildings or other large structures.

It is well known to provide an air supply system for a building, which system includes a main air supply duct, branch supply ducts and a fan unit. Often an air conditioning unit will form part of this system in order to cool the air that is being forced through the ducts. A problem often encountered with such systems is that the fan unit can produce a substantial noise and this noise can be carried through the ductwork and thereby be heard by persons in the building or structure. Not only is this a problem downstream of the fan unit, but it can also be a problem, at least in the immediate vicinity of the fan unit, on the upstream side since sound can travel out through the passageways that feed air to the fan unit. The noise created by the large fans in these systems is a particular problem in those buildings which must or should be kept reasonably quite, for example in hospitals and other buildings where the occupants are sleeping on a regular basis.

In addition to providing some noise attenuation, an air duct structure located downstream from a fan unit often is required to deliver the airflow from the fan to one or more air filters or perhaps to an air conditioning unit. In such cases it can be important for the air stream provided at the outlet of the duct structure to be relatively uniform across the width and height of the outlet. In this way, the amount of air flowing through each filter or each section of the filter, would be approximately the same.

In the construction of the duct structure located immediately downstream from a fan unit, it can be advantageous if the size of the air flow passageway is gradually increased from the inlet to the outlet of the duct structure. By increasing the size of the passageway in this manner, the air flowing through the passageway is allowed to expand gradually, thus permitting the velocity energy of the air to be recovered. As a result, the static pressure of the airflow is thereby increased. A gradual expansion of the size of the passageway is important in order to obtain maximum regain of air velocity pressure. By constructing the outlet duct structure in this manner, one could use a smaller size of fan motor to supply the same size of building than would otherwise be the case.

Another requirement of the duct structure located downstream from an air supply fan unit, is the frequent need to convert the airflow passageway from one having a round cross section at the outlet of the fan unit to one having a rectangular cross section. It will be appreciated that a rectangular air supply duct generally provides a more efficient use of the space available in a building for such ducts. Accordingly, it is often a requirement in a building that the air supply ducts and particularly the main ducts be substantially rectangular or square. The distance available to a duct designer or an air duct supplier for making this transition from a round cross-section to a rectangular one will vary from one job site to the next but, at least for some building sites, the transition distance can be quite short.

U.S. Pat. No. 4,418,788 issued Dec. 6, 1983 to Mitco Corporation describes a combined branch take-off and silencer unit for an air distribution system. This combined apparatus has two series-coupled sections, the first being a static pressure regain section and the second section having a main airflow passageway extending along its centre axis and branch ducts which connect smoothly with the main passageway. The structure is constructed with internal walls made of perforated metal sheets which overlays fibreglass packing provided for sound absorption. The main duct in this apparatus has a circular cross-section.

U.S. Pat. No. 4,295,416 issued Oct. 20, 1981 to Mitco Corporation describes a building air distribution system with a mixing plenum for receiving and mixing outside and return air. There is an input flow concentrator and integral silencer disposed within the plenum. The output port of this unit is connected to a fan unit which drives the air to the main duct of the building. The concentrator/silencer has inner and outer sections which are axially symmetrical about a vertical axis. It has an input port which extends symmetrically about this axis and a circular output port at the top. The inner and outer sections are lined with acoustically absorbing material.

U.S. Pat. No. 4,986,170 dated Jan. 22, 1991 issued to the present applicant describes a branch take-off airflow device which can be used immediately downstream of a fan unit. In the take-off section of the unit, the take-off passageways are rectangular in transverse cross-section whereas the main airflow passageway extending axially through the unit has a circular cross-section. In this main passageway there is an elongate airflow defining member which has a round, transverse cross-section with a maximum diameter equal to the diameter of the hub of the adjacent fan.

British patent No. 1,423,986 in the name of Alan Dodson et al, published Feb. 4, 1976, describes a silencer duct designed for use in a roof opening where an extractor fan is located above the opening. Opposite sidewalls of the duct are lined with sound absorbing material such as glass fibre slabs. Additional silencing is provided in the form of flow-splitter baffles which are flat and parallel to each other. This duct unit has a rectangular cross-section. The baffles themselves contain sound absorbing material.

It is an object of the present invention to provide improved air duct structure for placement adjacent an air supply fan unit for a building or other large structure. The air duct apparatus is provided with good sound attenuating capabilities.

It is a further object of the invention to provide a sound attenuating duct unit for placement adjacent an air supply fan unit wherein the duct unit has one or more substantially curved airflow passageways.

SUMMARY OF THE INVENTION

According to one aspect of the invention, a sound attenuating duct unit for placement at an outlet of an air supply fan unit for a building or other large structure includes a housing having exterior sides and internal walls surrounding a substantially curved, main airflow passageway, a circular air inlet for said passageway in one of said exterior sides for arrangement next to an outlet of said fan unit, and a rectangular air outlet for said passageway in another exterior side of said housing, which side extends at a substantial angle to said one exterior side, said internal walls providing a gradual transition in the transverse cross-section of the main airflow passageway from circular to rectangular, wherein sound absorbing material is arranged between said internal walls and said exterior sides of the housing and surrounds said airflow passageway.

In a preferred duct unit described herein, splitter apparatus is mounted in the main airflow passageway and extends from one side of this passageway to an opposite side thereof, splitting the main airflow passageway into smaller passageways.

In a preferred embodiment of the air duct outlet apparatus, there is a central airflow defining member rigidly mounted in the housing and extending to the inlet adapted for connection to the fan unit. This airflow defining member causes the airflow passageway to be annular at the inlet. The airflow defining member is filled with sound absorbing material.

According to a further aspect of the invention, there is provided a sound attenuating duct unit suitable for placement adjacent an air supply fan unit for a building or other large structure, said duct unit comprising an exterior housing having top, bottom and end walls forming outer surfaces of said housing, an annular opening in one end wall of the housing for arrangement next to one end of said fan unit, the annular opening having a central axis extending perpendicular to said one end wall, two rectangular openings located on opposite sides of the housing, said opposite sides extending at a substantial angle to said one end wall; and interior walls arranged in the housing, connected to the top, bottom and end walls, and defining airflow passageways which are substantially curved in an axial plane extending through said central axis, the annular opening and rectangular openings being connected by the airflow passageways so that the airflow through the annular opening also flows through the rectangular openings, wherein the interior walls contain sound absorbing material which surrounds the airflow passageways.

Further features and advantages will become apparent from the following detailed description taken in conjunction with the accompanying drawings which illustrate preferred embodiments of the invention.

BRIEF DESCRIPTION OF THE DRAWINGS

FIG. 5*a* is one half of a composite section of the air duct inlet structure taken along the line Va—Va of FIG. 4;

FIG. 5*b* is the other half of the composite section of the air duct inlet structure taken along the line Vb—Vb of FIG. 4 showing the flat floor of the upper section and in chain dot lines the outline of the passageway above the plane of the section;

FIG. 7 is a detail view of the transverse cross-section of a typical splitter used in the air duct outlet structure of FIG. 6;

FIG. 8 is a detail view, with sections removed, of the splitter of FIG. 7, which view shows an inner horizontal plate support;

DETAILED DESCRIPTION OF PREFERRED EMBODIMENTS

Figure 1:
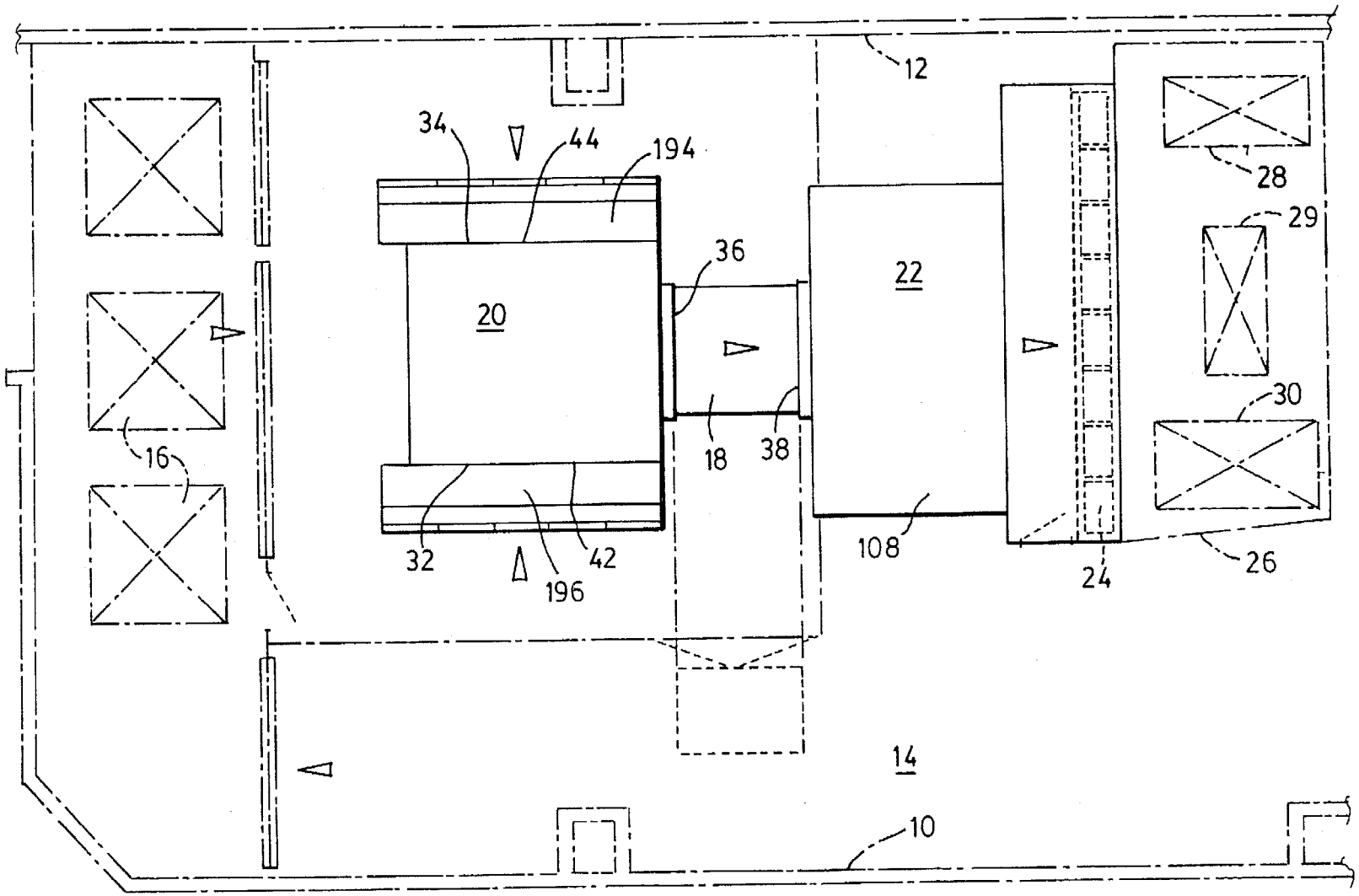
FIG. 1 is plan view of a typical equipment room in a building wherein air duct silencing apparatus has been installed.

FIG. 1 illustrates a typical equipment room constructed to house the air supply equipment for a building or other large structure. Outlined in dashed lines are the walls 10 and 12 of this room 14. Located at one end of the room and also indicated in dashed lines are three inlets 16 which supply outside air to the room and to the air supply equipment. Centrally located in the room and preferably accessible for removal or repairs is an air supply fan unit 18 which drives the air from a combined air duct inlet apparatus and silencer 20 to a combined air duct outlet apparatus and silencer 22. The fan 18 itself can be of standard construction and the unit 18 per se does not form part of the present invention.

In the preferred arrangement shown, the outlet apparatus 22 supplies air to a bank of or series of air filters 24 through which the air flows to a rectangular plenum 26 shown in dashed lines and possibly to several smaller, rectangular supply ducts 28 to 30. Alternatively, the outlet apparatus 22 may supply air directly to a large rectangular supply duct.

It will be understood that incoming air enters the duct inlet apparatus 20 from opposite vertical sides 32 and 34 and accordingly these sides should be spaced an adequate distance from the walls of the room, for example four to five feet. It will also be understood that the standard fan unit 18 has a circular air inlet at the end 36 of the unit and a circular air outlet at its downstream end 38. Accordingly, the outlet for the air duct apparatus 20 and the inlet for the air duct outlet apparatus 22 are also circular and preferably of corresponding size.

Figure 2:
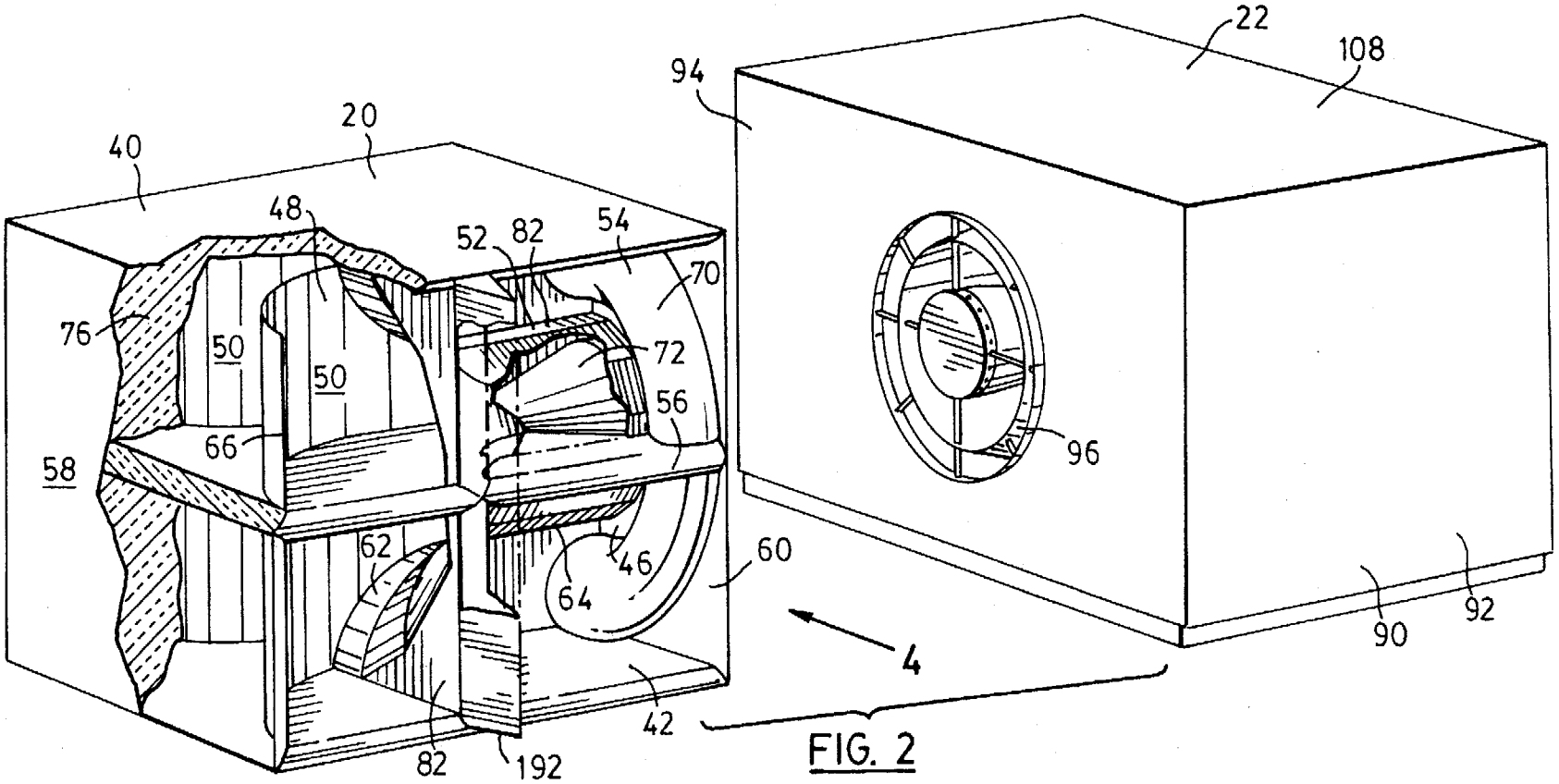
FIG. 2 is a perspective view showing vertical sides and the top of both an air duct inlet structure and an air duct outlet structure in approximate relationship.
Figure 3:
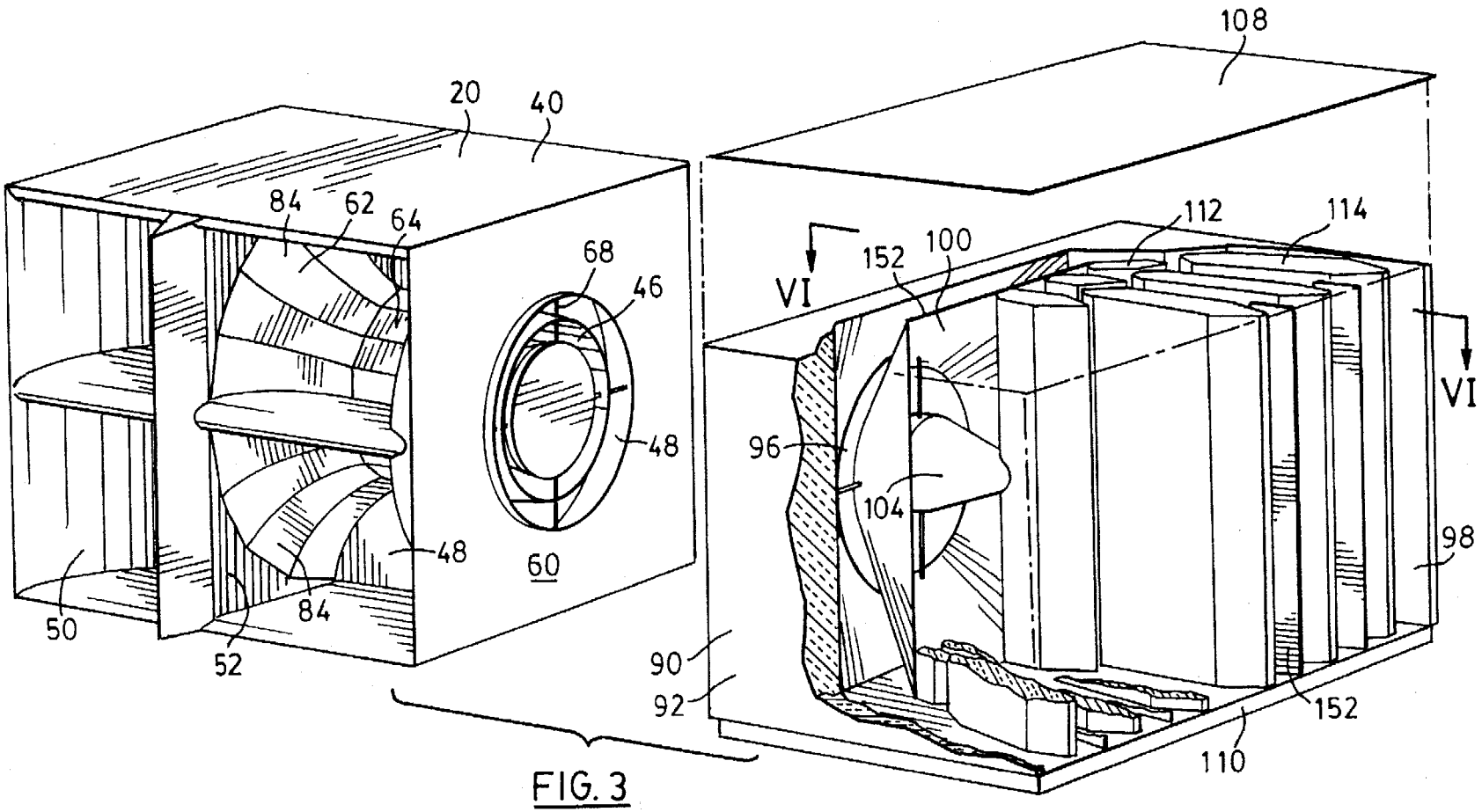
FIG. 3 is another perspective view showing the outlet ends of the air duct inlet structure and the air duct outlet structure of FIG. 2 in which the top panel of the outlet structure has been exploded and in which the outlet structure is broken away for purposes of illustration.

Referring now to FIGS. 2 and 3 of the drawings, the duct inlet apparatus 20 includes an exterior housing 40 having two principal, rectangular air inlets or openings 42 and 44 located at sides 32 and 34 respectively, that is on opposite vertical sides. This unit also has a single annular air outlet or opening 46 located in rear or end wall 60 of the housing and adapted for connection to the fan unit for air flow to the latter. Thus the two inlets lie in spaced apart, substantially parallel planes while the air outlet 46 lies in a plane arranged at a 90 degree angle to these parallel planes. The circular outlet defines a central axis perpendicular to rear or end wall 60. The air inlets 42 and 44 and the outlet opening 46 are connected by main airflow passageways 48 defined by interior walls 50, 52 and 54, which passageways curve about 90 degrees from the inlets to the outlets. The main passageways 48 are each separated by interior walls into four small airflow passageways. These small passageways are substantially curved in an axial plane extending through the central axis of the outlet 46. At least sections of the interior walls are preferably made of perforated sheet metal to provide sound attenuation. Preferably each rectangular inlet is divided into four generally rectangular segments as illustrated but with larger units more than four segments for the inlet on each side can be constructed. The segments are of similar size. The upper and lower segments are separated by a horizontal divider 56 which extends from a front wall 58 to rear wall 60. The left and right segments are separated by the aforementioned interior wall 52, which is shaped like one half of a funnel divided along a central axial plane, in the main passageway 48. It thus has a curved section 62 which extends to a semi-cylindrical section 64. The interior wall 50 is a vertical wall that is curved in plan view. Its leading edge 66 is located at the front wall 58 while its rear edge 68 is located near the outlet opening 46 as shown in FIGS. 5*a* and 5*b*.

With respect to interior wall 54, it forms an annulus at 70 which is semi-circular in cross-section. The purpose of this annulus is to help smooth the flow of air into the fan unit and to help avoid a direct line of sight from the inlet of the fan unit through the passageway 48. Because the sound is unable to pass directly from the front of the fan to the interior of the room 14, the amount of noise is reduced.

The duct inlet apparatus is also provided with a central airflow defining member in the form of conical plate 72, which plate is rigidly mounted in the housing in the airflow passageway 48. The wide end of this member is located at the annular outlet or opening 46. With this conical plate, which is also made of perforated metal and contains sound absorbing material, and the internal walls 50 and 54, the two airflow passageways 48 join and form an annular passage at the outlet 46 (see FIG. 3). Thus, the shape and size of the combined passageway at this outlet corresponds to the shape and size of the inlet (not shown) of fan unit 18.

In order that the duct inlet apparatus 20 will also act as a silencer, the housing contains sound absorbing material, which material is indicated generally at 76. The sound absorbing material extends to and is covered by the internal walls 50, 52 and 54. In preferred embodiments of both the duct inlet apparatus 20 and the outlet apparatus 22 there are at least two types of sound absorbing material used. The first type is the relatively thin layer, for example, one half inch, of fibreglass insulation which has a cloth backing. A suitable form of this insulation indicated at 78 in FIGS. 5*a* and 5*b* is Knauf Ductliner-M. This material has zero erosion of the fibreglass insulation at air velocities up to 6,000 feet per minute. Because of this zero erosion characteristic it is placed directly against the back of the perforated metal plate which forms the interior walls of the duct/silencer with the cloth backing lying against the perforated sheet metal. Behind the material 78 is placed standard low density acoustical filler 80 which is used to fill the remainder of the cavity between the internal walls and the exterior walls of the housing. For example, this standard fibreglass acoustical filler can be purchased in the form of bats that are 3 inches thick and when placed in the duct/silencer it is compressed to some extent (for example from 3 inches to 2 inches in thickness) in order that it will completely fill the space and have good sound absorbing capabilities.

In a preferred embodiment of the apparatus 20, only a portion of the internal wall 52 is made of perforated metal sheet. In fact, all of the side of wall 52 that faces the internal wall 50 and the conical plate 72 is made of imperforate galvanized metal sheet (for example 16 gauge). The imperforate sheet metal is indicated at 82. Only the curved portion of internal wall 52 which faces the internal wall 54 is constructed of perforated metal sheet, typically 22 gauge. This perforated sheet is indicated at 84 in FIG. 3. The reason for the use of the two different sheet materials is that the perforated sheet is only used where there is room for sound absorbing material to be placed behind the metal sheet.

It will also be appreciated by those skilled in this art that the apparatus 20 could also be used as a duct outlet apparatus/silencer for placement immediately downstream of the fan unit, if desired. Such a use would provide enhanced sound attenuation as well as uniform air delivery to the two outlets of the duct unit.

Reference will now be made to the main components and structure of the duct outlet apparatus/silencer 22 which is connected to the outlet side of the fan unit 18. The duct apparatus 22 includes an exterior housing 90 with sidewalls 92, a front end wall 94 containing an annular air inlet 96 and a rectangular air outlet 98. The inlet 96 and the outlet 98 are connected by a main airflow passageway 100 defined by interior walls 102 of the housing (see FIG. 6).

The duct apparatus 22 contains a central airflow defining member 104 which is rigidly mounted in the housing in the passageway 100. This conical member 100 tapers and extends from the region of the inlet 96 to a centrally located splitter 106 described further hereinafter. Thus, between the member 104 and the interior wall 102, the passageway 100 is substantially annular. The member 104 is filled with sound absorbing material in the manner described above in connection with the inlet apparatus 20. This sound absorbing material also fills the space behind interior walls 102 and surrounds the passageway 100. In the outlet duct apparatus 22 the main passageway 100 is shown as substantially straight although the passageway increases in transverse cross-section from the inlet to the outlet. However, it will be appreciated that an outlet duct apparatus constructed in accordance with the invention can be made with a curved main passageway that, for example, curves about 90 degrees from the air inlet to the air outlet. In this case the outlet of the unit would be at a side of the housing rather than at the end thereof which is opposite the end wall 94. The air inlet 96 corresponds substantially in size and shape to the outlet (not shown) of the fan unit 18.

Figure 6:
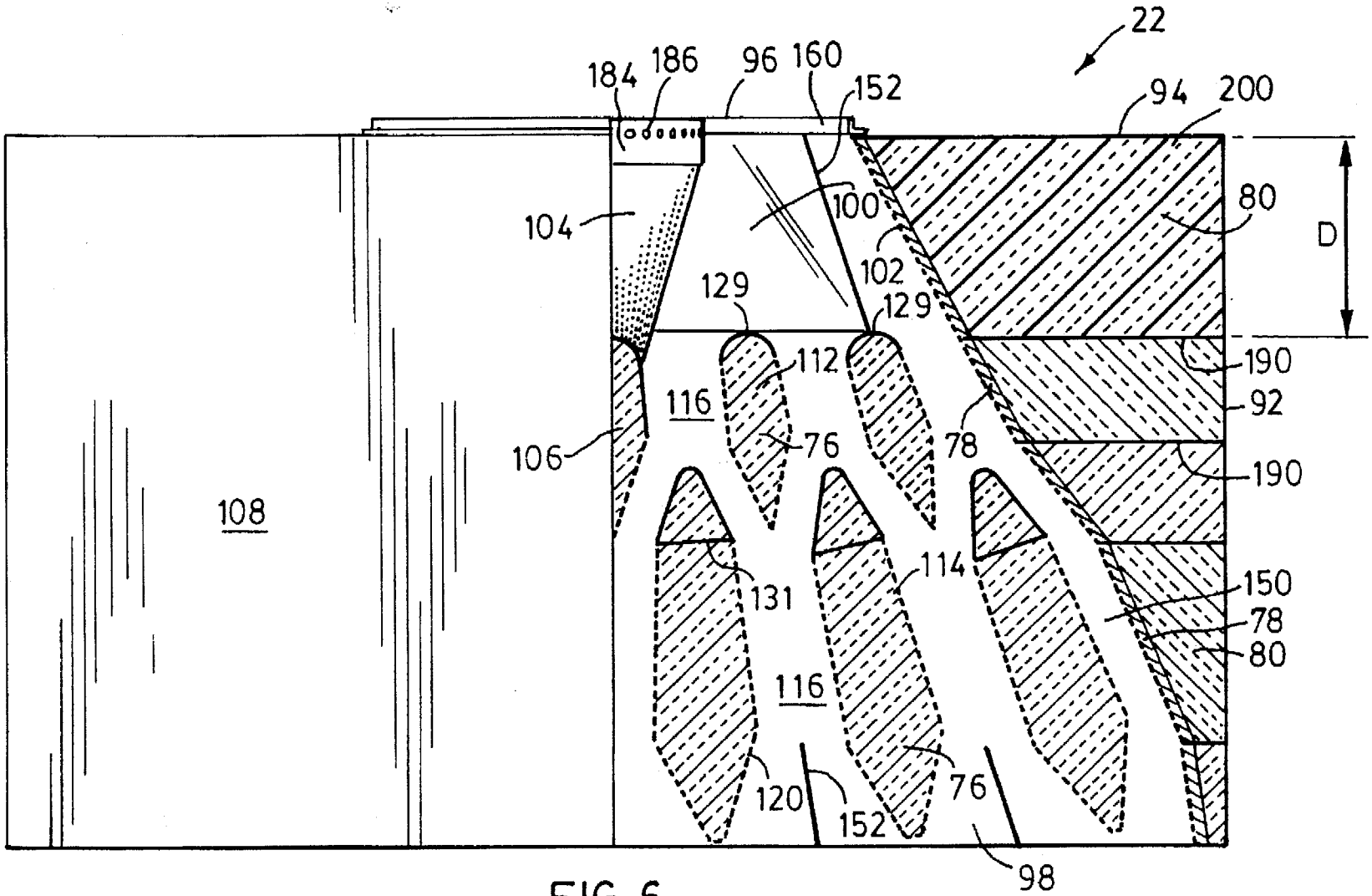
FIG. 6 is a plan view of an air duct outlet structure with one half of the view in cross-section along the line VI—VI of FIG. 3.

The outlet apparatus 22 has a top sidewall 108 and a bottom sidewall 110. Between these two walls or panels extend at least first and second series of air stream splitters 112 and 114 with the splitters of each series being spaced apart to forms mailer air passageways 116. The splitters of each series are mounted side-by-side in a row as shown in FIGS. 3 and 6 with the second series comprising the splitters 114 positioned downstream in the airflow passageway 100 relative to the first series comprising the splitters 112. Also, the splitters 114 are staggered relative to the first series transverse to the direction of air flow in the passageway. In this way there is no direct line of sight from the inlet 96 to the outlet 98, thus preventing sound waves from travelling directly from the inlet to the outlet. This is due in part to having the width of the splitters correspond closely to the width of the passageways 116 between the splitters of the other series.

The construction of each splitter will now be discussed in detail with references to FIGS. 3, 6, 7 and 8. Each splitter 112 and 114 contains sound absorbing material 76. Again, this material can comprise the two types of fibreglass material described above in connection with inlet apparatus 20. Each splitter is a straight elongate member which extends vertically substantially the entire height of the outlet duct apparatus 22. Each splitter is formed with perforated sheet metal 120 which covers the sound attenuating or sound absorbing material 76 contained in the splitter. Preferably the fibreglass insulation in the nose area 122 is packed to a higher density to improve the sound attenuating characteristics of the splitter. In the illustrated preferred embodiment the nose area is packed with acoustical filler to a density of 1.6 lbs per cu.ft. while the remainder of the splitter is packed with the same filler to a lower density of only 1.2 lbs per cubic foot. The nose section 122 including the rounded nose 124 which forms the upstream end is made of imperforate metal. The nose 24 is preferably a length of metal tubing 126 (for example, 2 inch outer diameter tubing). In one preferred embodiment, the total depth of the splitter from the nose 124 to tail end 128 is 45 inches while the depth of the splitter 112 is 25 inches. In this version, the splitter 114 has the maximum width of 12 inches while the corresponding splitter 112 has a maximum width of 8 inches. Also, as shown in FIG. 6, the nose portion of each splitter 112 is semi-circular in cross-section and is more rounded than the nose area of each splitter 114. The nose area 129 can be made from imperforate 18 gauge galvanized sheet metal that is welded to the perforated metal forming the sides of each splitter 112. The use of imperforate metal in the nose region has distinct advantages in that it reduces air friction at the region of impact of the air flow with the splitter and it helps maintain airflow speed through the duct unit. Optionally one can provide an internal partition wall 131 that separates the nose area from the rest of the splitter. This plate extends the entire height of the splitter and acts to separate the two densities of filler material.

The number of splitters in each row and their geometry can vary based on the desired length, width, height and sound absorption capacity of the duct apparatus 22. Also, if the main airflow passageway bends from inlet to outlet, the splitters can also bend or curve in their transverse horizontal cross-section to match the curve of the passageway.

FIG. 8 illustrates how each splitter 112, 114 can be provided with one or more intermediate, horizontal support plates 130 which are welded to the exterior metal sheets by means of flanges 132. Each support 130 can, for example, be made of 18 gauge imperforate metal sheet. In addition to providing added strength, the support plates 130 help to support the sound absorbing material and prevent it from settling unduly. FIG. 8 also illustrates the use of imperforate top and bottom plates 134 and 136 which are used to connect the splitter to the top and bottom walls of the housing.

As shown in FIG. 7, the preferred splitter 114 has three sections moving in the direction of airflow through the duct unit. These include a short nose section 140, a larger central section 141 with flat opposing sidewalls, and a tapering tail section 142. This provides the splitter with a streamlined exterior that will not slow down the flow of air an undesirable amount. Preferably the sidewalls 144 diverge slightly in the direction of airflow.

It will be appreciated that the aforementioned internal walls 102 provide a gradual transition in the transverse cross-section of the main airflow passageway 100 from circular to rectangular, it being noted that the air inlet 96 has a circular periphery while the air outlet 98 is rectangular. This gradual transition takes place over a relatively short distance indicated by the letter D in FIG. 6 relative to the total front to back dimension of the outlet apparatus 22. For example, in one preferred version of the apparatus 22, the distance D is 2 feet whereas the total distance from end wall 94 to the outlet 98 is 7 feet. Accordingly, in the region of the air passageway where the splitters 112 and 114 are mounted, the passageway has a rectangular cross-section. The transverse cross-section of the passageway 100 gradually increases from the air inlet 96 to the air outlet 98 as shown, whereby the air velocity pressure of air flowing through the passageway is recovered. The rectangular air outlet 98 is substantially larger than the circular air inlet.

In addition to the function of sound attenuation, another function of the splitters 112 and 114 is to divide the airflow in the main passageway evenly across the width thereof. For this reason the splitters in each series are substantially evenly spaced apart as shown in FIG. 6 so as to create the smaller air passageways 116 between them, which are substantially equal in transverse width (as well as in height). Small outer passageways 150 have a width about one half the width of passageways 116 between the splitters 114. It will be understood that by having the splitters so arranged that they split the stream of air evenly at each series of splitters, one will achieve a substantially uniform air stream at the outlet 98 where the air is combined again into a single air stream. In this way the air stream will strike the air filters 24 evenly, thus causing the filters to operate with maximum efficiency and to have a longer operating life before cleaning or replacement. Also, a gradual expansion of the air flow in the duct apparatus 22 (as permitted by the splitters) results in maximum static pressure regain. The outlet duct apparatus 22 has the basic advantages of saving both space and energy, the space being gained by having the transition from circular to rectangular cross-section incorporated into the body of the silencer.

Preferably in the region of outlet 98 there are additional flat splitters 152. These can be made of flat, imperforate sheet metal connected at the top and the bottom to the housing (typically by welding).

Another advantageous feature of the present invention which is found in the outlet duct apparatus 22 is diffusing baffle means rigidly mounted in the airflow passageway 100 to provide more uniform air distribution at the air outlet 98. In the illustrated embodiment, the diffusing baffle means comprises a single baffle member 152 made of imperforate metal plate. In one preferred embodiment, the diffusing baffle member is made of 16 gauge galvanized sheet metal and has a length of about 2 feet, the same as the length of the gradual transition from circular to rectangular in the cross-section of the main airflow passageway. The member 152 extends about a central axis of the airflow passageway 100 and acts to reduce the angle of expansion of air flowing through this passageway. The sheet metal member is formed with multiple bends so that its transverse cross-section goes from round at the inlet 96 to rectangular (see FIG. 3). The member 152 also increases the performance of the outlet duct apparatus 22 from the standpoint of velocity regain in the air flow.

The downstream end of baffle member 152 is arranged to meet the nose 129 of the outer splitters 112, preferably in the center of this nose as shown in FIG. 6. It will thus be appreciated that air entering the inlet 96 at the point 160 is forced to flow on the outside of the baffle member 152 and once it reaches the outer splitter 112, is forced to flow on the outside thereof.

Figure 4:
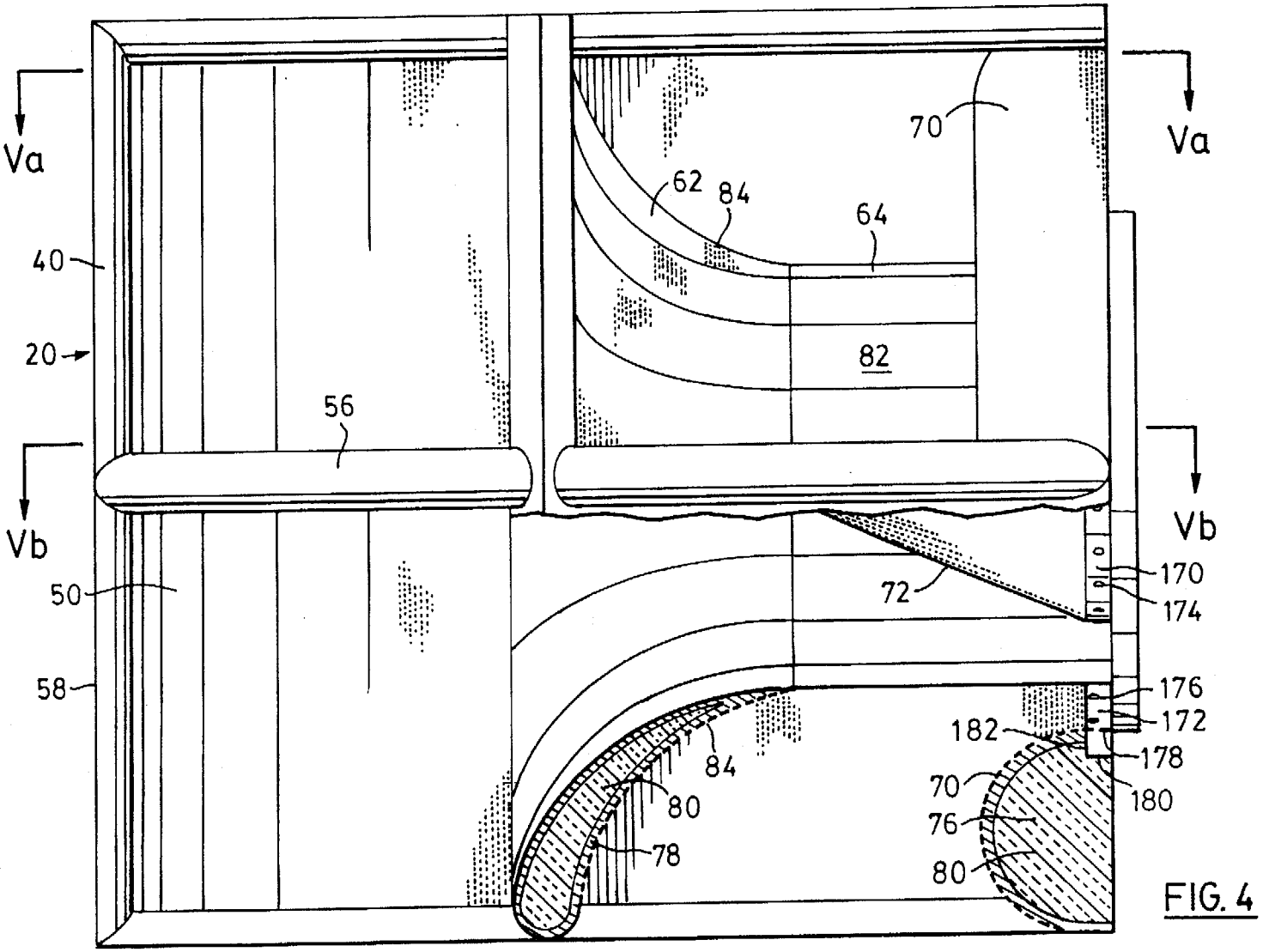
FIG. 4 is a side elevational view, partly in cross-section, taken in the direction of the arrow 4 shown in FIG. 2 showing the air duct inlet structure (in the lower half, a central interior wall has been broken away to reveal an inner air passage and a cone member)

Both the inlet duct apparatus 20 and the outlet duct apparatus 22 are preferably provided with resonator means for reducing the noise created by the operation of the fan unit, particularly peak blade passage frequency noise. In each duct unit, this resonator means comprises one or two hollow resonator chambers located adjacent the one inlet or outlet that is adapted for connection to the fan unit. As shown in FIGS. 4, 5*a* and 5*b*, in the inlet duct apparatus 20, there are two resonator chambers 170 and 172, each of which is provided with a number of holes 174, 176. The use of only one resonator chamber is also possible. Each of these chambers is enclosed by chamber walls including a peripheral wall which contains the holes 174 and 176. The chamber 172 is annular extending around the outside of the air passageway 48 while the chamber 170 is a flat, circular chamber having a diameter equal to that of the wide end of the perforated plate that forms conical member 72. Thus, the chamber 170 is encircled by the air passageway. In each case, the peripheral wall that contains the holes 174 and 176 faces the airflow passageway. Also, as shown in FIGS. 4 and 5, the annular chamber 172 is defined by four walls including inner and outer circumferential walls 178 and 180, radially extending sidewall 182, and the rear wall 60 of the housing. In a preferred embodiment, the chamber walls are made of 16 gauge sheet metal and are imperforate except for the aforementioned holes 174, 176. In one preferred embodiment wherein the outside diameter of the annular outlet is 55 inches, the annular chamber 172 had 23 holes each measuring one inch in diameter spaced evenly about the circumference of the chamber. The outside diameter of the chamber 172 was 61 inches and its height was 3 inches. In this same embodiment, the circular chamber 170 had a diameter of 28 inches, a width of 2⅝th inches and 23 holes of the same one inch size. Two resonator chambers were used in the inlet duct unit because the annulus area at the outlet was treated as two annular areas with each being treated as a separate duct. Thus the chamber 170 is provided for the inner annular area while the chamber 172 is provided for the outer annular area. The total volume of the two chambers and the number of holes adds up to the required volume and holes for a single duct of the same size.

Turning now to the resonator chamber of the outlet duct apparatus 22, this chamber 184 is located at the wide end of the conical air flow defining member 104. It is a flat, circular resonator chamber similar to the above described chamber 170. The chamber 184 is surrounded by the annular airflow passageway and evenly distributed about its circumference are a number of holes 186. In one preferred embodiment of the outlet duct apparatus wherein the outer diameter of the annular passageway at the inlet 96 was 4'7", the chamber 184 had an outside diameter of 21 inches and a width of 5⅛th inches. In this embodiment there were 20 holes, each having a diameter of 1¼ inch.

The resonators 170, 172 and 184 incorporated into the air duct apparatus of the invention provide means for changing the acoustic impedance of the air supply system. These resonator chambers act as additional noise control elements. The transmission loss of a resonator installed in an air duct having a cross sectional area $S_1$ is given by the following formula:

$$L_{TL} = 10 \log_{10} \left[ 1 + \frac{\alpha + 0.25}{\alpha^2 + \beta^2 (f/f_0 - f_0/f)^2} \right] \text{dB}$$

where $\alpha$=resonator resistance (dimensionless)=$S_1 R_5/\lambda_0 \sigma c$ $\beta$=resonator reactance (dimensionless)=$S_1 c/2\ \pi f_0 V$ $S_1$=area of main duct, $m^2$ $R_5$=flow resistance in resonator tubes, mks rayls V=volume of resonator, $m^2$ $\lambda_0$=total aperture area, $m^2$ $f_0$=resonance frequency, Hz $\sigma$=density of gas, $kg/m^3$ c=speed of sound, m/sec $S_1$ here is the size of the annular open area at the outlet or inlet in the case of an annular airflow passageway. The total aperture area $A_0$ is obtained by simply multiplying the number of small holes (174 or 176) into the chamber by the area of each hole. Thus, the selected size and number of holes is not critical but as a practical matter, the holes should not be too small and it is preferred that they be at least ½ inch in diameter.

The density of gas p is simply the density of the gas or air that is flowing through the duct unit. It is a preselected density based on the design parameters of the system. The above-mentioned resonator chambers were constructed to attenuate fan blade passage frequencies in the 237 Hz range based on a fan unit with eight blades operating at 1775 R.P.M.

Using this formula, one can obtain the necessary information for calculating the details of a resonator chamber useful in a particular air supply duct system. These details include volume, throat diameter and acoustic resistance. It will be appreciated that the size and arrangement of the resonator chamber to be used and the number of holes in the peripheral wall will vary depending upon the frequency of the noise created by the fan unit which is to be reduced.

In a preferred embodiment, the space between the internal wall 102 and the external sidewall 92 of the outlet duct apparatus 22 contains a number of partition walls indicated at 190 which can be vertical walls extending from top to bottom of the unit. The arrangement and spacing of these walls can vary depending upon the particular structural support required. The space between these walls 190 is filled with the aforementioned glass fibre insulation and the partitions 190 help to support same. They also support the interior wall 102 which is made of relatively thin sheet metal.

In a preferred embodiment of outlet duct apparatus 22, the density of the sound absorbing material packed between the interior walls and the exterior walls of the housing is varied along the length of the air flow passageway in order to increase sound attenuation by the apparatus. One can obtain optimum performance in this unit if the acoustic impedance of the silencer walls is kept within a certain range of values. In particular, the flow resistivity of the dissipative or sound absorbing material should have a value given by the following equation:

$$R = 6.6\ (\text{duct dimension})(\text{design frequency})/(d)\ MKS\ \text{rayls}/m$$

In this equation, the letter R is the flow resistivity, a factor that varies according to the density of the sound absorbing material used. The letter d is the thickness of the sound absorbing material at a selected location along the length of the airflow passageway. The duct dimension referred to is the width or diameter of the airflow passageway at the selected location and the design frequency is the frequency of the sound which the duct apparatus is made to absorb or attenuate. The dimension d is normally constrained to yield 50% open area of the silencer. In other words, the thickness of the sound absorbing material adjacent a particular location along the duct should be at least 50% of the immediately adjoining airflow passageway. In order to obtain optimum performance, the flow resistivity must be altered to suit the particular application and required duct arrangement. For sound absorbing materials commonly used in air duct silencers, the flow resistivity is given by the following equation:

$$R = K(\text{bulk density})^{1.53}$$

wherein K stands for a constant that would depend on the particular material used.

It will be appreciated that the flow resistivity of a given material can be increased by increasing the packing density. The design chart shown in FIG. 9 of the drawings can be used to select the proper value of flow resistivity. This procedure can be used to maximize the silencer's performance at a specific frequency or to provide a wide band of virtual constant attenuation.

In the particular preferred embodiment of an outlet duct apparatus that is shown in FIGS. 6, 7, and 8, the above method for determining optimal flow resistivity of the sound absorbing material was used and this procedure resulted in the use of low density acoustical filler having a density of 0.8 lbs per cubic foot in the compartment 200 located closest to the inlet 96 and extending between the end wall 94 and the first partition wall 190. The acoustical filler in the remaining, smaller compartments, had a higher density of 1.2 lbs per cubic foot. In other words, this higher density was used from the first of the partition walls 190 to the outlet end of the unit. In this particular preferred embodiment constructed by the applicant, the depth of the first compartment containing the lower density filler was two feet and the remaining compartments had a total depth of five feet. The width of the housing for this outlet duct apparatus was twelve feet. The diameter of the inlet opening of the unit was 4'7".

FIG. 6 is drawn substantially to scale so that all the dimensions of the various components and sections of this unit can be seen from the drawing.

In this unit, as indicated earlier, the density of the acoustic filler in the splitters is also varied. In particular, in each of the splitters 112 and 114 of this preferred embodiment, the density of the filler in the nose area was 1.6 lbs per cubic foot while the density of the filler in the remainder of the splitter was 1.2 lbs per cubic foot.

It will be seen that in this particularly preferred embodiment of the outlet duct apparatus, the density of the sound absorbing material for the entire length of the airflow passageway does not exceed 2 lbs per cubic foot. This compares to conventional air flow silencers where the density of the sound absorbing material is substantially higher throughout the unit, typically in the 3 lbs per cubic foot range.

Figure 9:
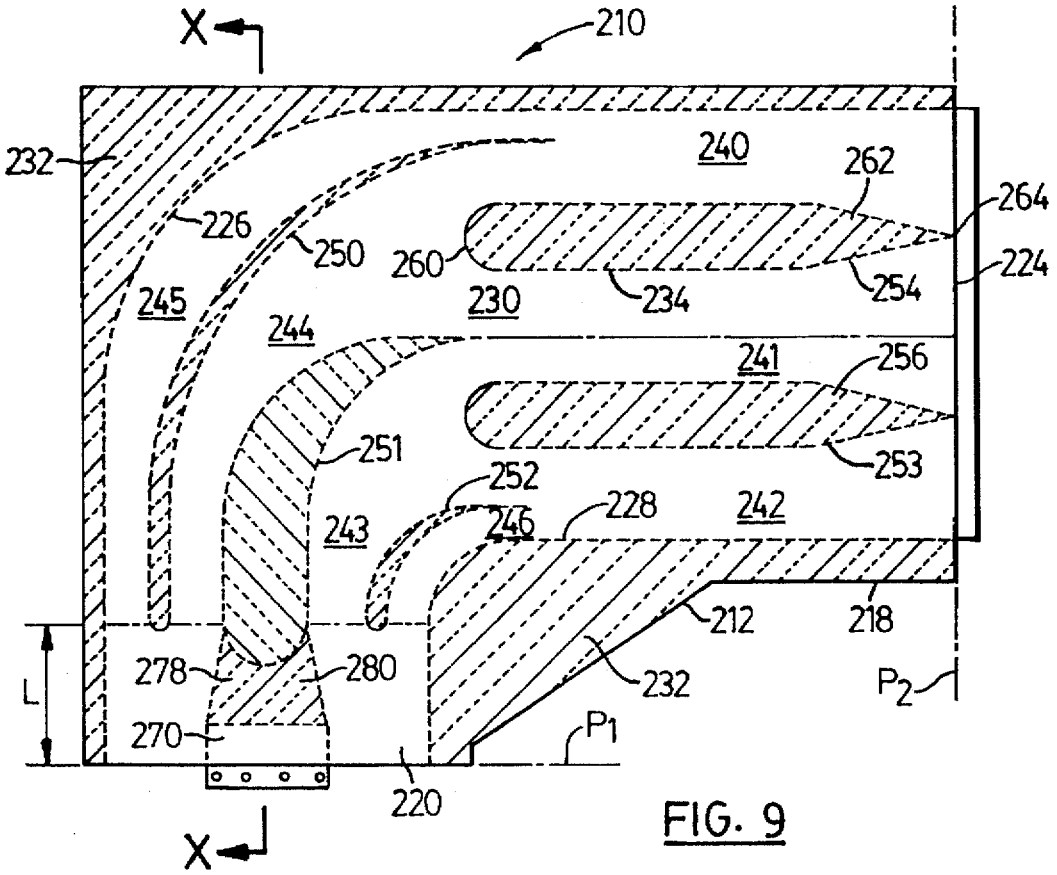
FIG. 9 is a cross-sectional view taken through the center of the annular air inlet of a further embodiment of an outlet silencer.
Figure 10:
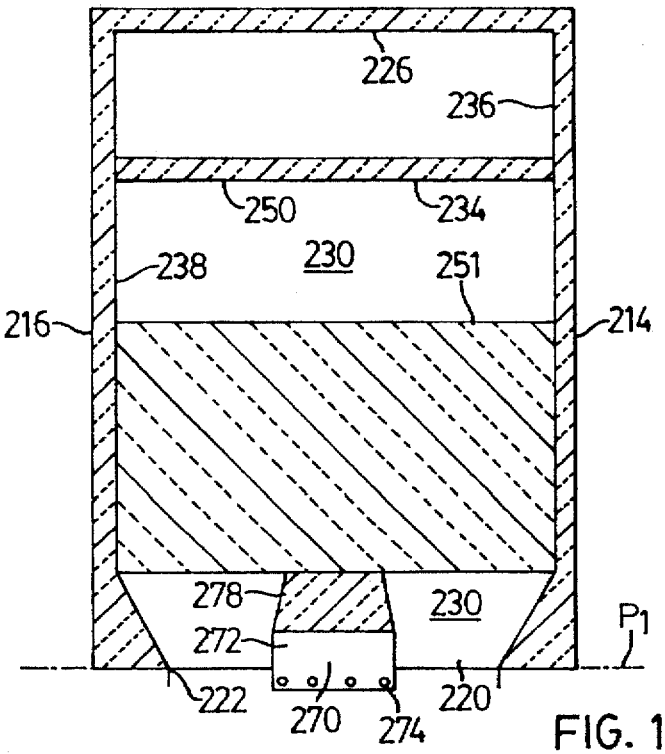
FIG. 10 is a cross-sectional view taken along the line X—X of FIG. 9.
Figure 11:
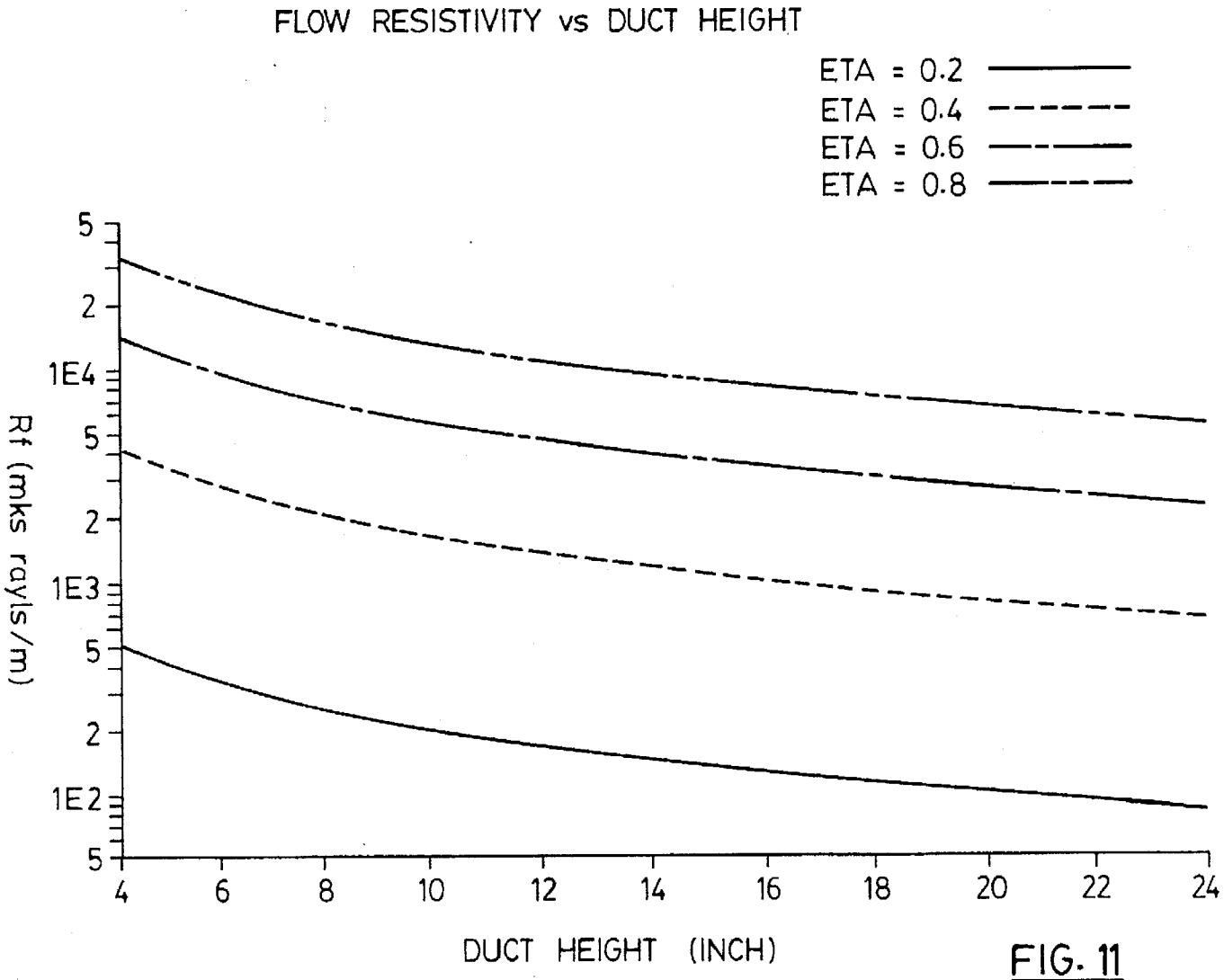
FIG. 11 is a graph or chart plotting flow resistivity versus duct height, which design chart can be used to select the flow resistivity for the sound absorbing material.

FIGS. 9 and 10 illustrate another embodiment of a sound attenuating duct unit 210 for placement at an outlet of an air supply fan unit such as the one described above. The duct unit 210 has an exterior housing 212 having exterior walls, including walls 214, 216 and 218, forming outer surfaces of the housing. This duct unit has an air inlet 220 with a circular outer perimeter located at 222 laying in a first plane indicated at $P_1$. It will be understood that the plane $P_1$ could be either vertical or horizontal. The duct unit also has a rectangular air outlet 224 in a second plane $P_2$ arranged at a substantial angle to the first plane $P_1$. In the illustrated preferred embodiment, the second plane $P_2$ is arranged at an angle of about 90 degrees to the first plane $P_1$. It will be understood that the air inlet 220 is adapted for connection to the fan unit in order to receive airflow from the fan unit.

Interior walls 226, 228 are arranged in the housing and define a main airflow passageway 230 which is substantially curved in its lengthwise direction as shown in FIG. 9. The passageway 230 extends lengthwise from the air inlet 220 to the air outlet 224. The interior walls 226, 228 provide a gradual transition over the distance L in the transverse cross-section of the airflow passageway from circular to rectangular.

Sound absorbing material 232, the nature of which has already been described above, is arranged between interior walls 226, 228 and the exterior walls and covers sides of the airflow passageway 230.

Splitter apparatus indicated generally at 234 is rigidly mounted in the airflow passageway 230 and extends transversely from one side 236 of this passageway to an opposite side 238 thereof. As in the previously described embodiment, the splitter apparatus divides the main airflow passageway 230 into smaller passageways 240 to 246.

The splitter apparatus 234 comprises air stream splitters 250 to 254 of different sizes with each splitter containing sound attenuating material indicated at 256. As illustrated in FIG. 9, at least substantial portions of the splitters 250 to 254 are formed with perforated sheet metal exteriors. The illustrated splitters 250 to 252 are curved so as to follow the curve in the airflow passageway 230. Preferably these splitters have nose portions 260, which can be made of imperforate metal, which are semi-circular in cross-section (as seen in FIG. 9). The splitters have streamlined exterior walls with tapering tail sections 262 that taper to a straight edge 264.

A hollow resonator chamber 270, similar to that illustrated in FIG. 6, is located adjacent annular air inlet 220 and is capable of reducing noise created by operation of the fan unit. The chamber is enclosed by chamber walls including a peripheral wall 272 perforated with a number of holes 274 and facing the main airflow passageway 230. This resonator chamber 270 can be constructed in the manner already described above.

The unit 210 also has a central airflow defining member 278 which can be rigidly mounted to one wall of the resonator chamber 270 and which can taper inwardly as shown in the direction of the airflow. The member 278 is filled with sound absorbing material 280. The member 278 extends from the resonator chamber to a central air splitter 251 to which it is rigidly connected. Because the air flow defining member 278 extends to the air inlet 220, it will be understood that the main airflow passageway 230 is annular at the inlet. It should also be noted that if the resonator chamber 270 is omitted from the unit 210 (which is an option), then the member 278 would extend to the aforementioned plane $P_1$, which is the plane of the air inlet.

It will be understood that the interior walls 226, 228 of unit 210 are also made at least in part with or entirely with perforated sheet metal as illustrated in FIG. 9.

A test was conducted on behalf of the applicant wherein an 84,000 CFM (cubic feet per minute) axial flow flan unit was connected to an inlet silencer and an outlet silencer constructed in accordance with the invention. In this test, heat exchanger coils and filters were installed on the inlet unit and filters on the outlet unit. In order to provide some load to the fan, additional filter media was installed. Under these operating conditions, the pressure rise across the fan was measured to be 1.5 inch water gauge with a nominal delivery of 84,000 CFM. Sound level readings were taken with a calibrated B & K 2204 sound level meter connected to an octave filter set. Sound pressure levels were converted to sound power levels using the standard method of area corrections. Measurement locations were selected around the entire unit. A microphone was placed four inches from the unit under test, assuring that the conversion from sound pressure to sound power could be performed with errors of the order of 0.5 dB. The results are summarized in the following Table 1.

TABLE 1

Measured Sound Power M & I Heat Transfer 84,000 CFM Unit

| Hz | Fan (Woods data) | Fan Casing | Inlet Silencer | Outlet Silencer |
|---|---|---|---|---|
| 31.5 | | 95 | 90 | 92 |
| 63 | 108 | 92 | 87 | 91 |
| 125 | 110 | 99 | 87 | 85 |
| 250 | 116 | 103 | 95 | 90 |
| 500 | 114 | 96 | 97 | 84 |
| 1,000 | 112 | 90 | 94 | 84 |
| 2,000 | 108 | 85 | 90 | 80 |
| 4,000 | 102 | 83 | 90 | 72 |
| 8,000 | 96 | 82 | 85 | 73 |

It is evident from these results that the fan casing is the dominate radiator at low frequencies and that the inlet silencer radiates most of the high frequency energy. Some of the high frequency noise is generated by airflow through small gaps. The inlet system in the test was not sealed because of the need to disassemble it after the test. These gaps and the panels would of course be sealed when the unit tested is installed at an actual operating site. The acoustic energy passing through the silencer suffers additional attenuation as it travels down the air ducts. Using typical performance data from ducting and diffusers, one can expect NC35 in a 4,000 cubic foot room with 30 air exchanges per hour or NC28, if there are 6 air exchanges per hour. It will be understood that this system, as tested, is constructed for installation in an enclosure inside a mechanical room of a building. The wall construction of a typical enclosure normally has an STC rating of 25. Thus, the sound transmitted from the unit into the mechanical room will result in sound level equivalent to NC60.

Figure 12:
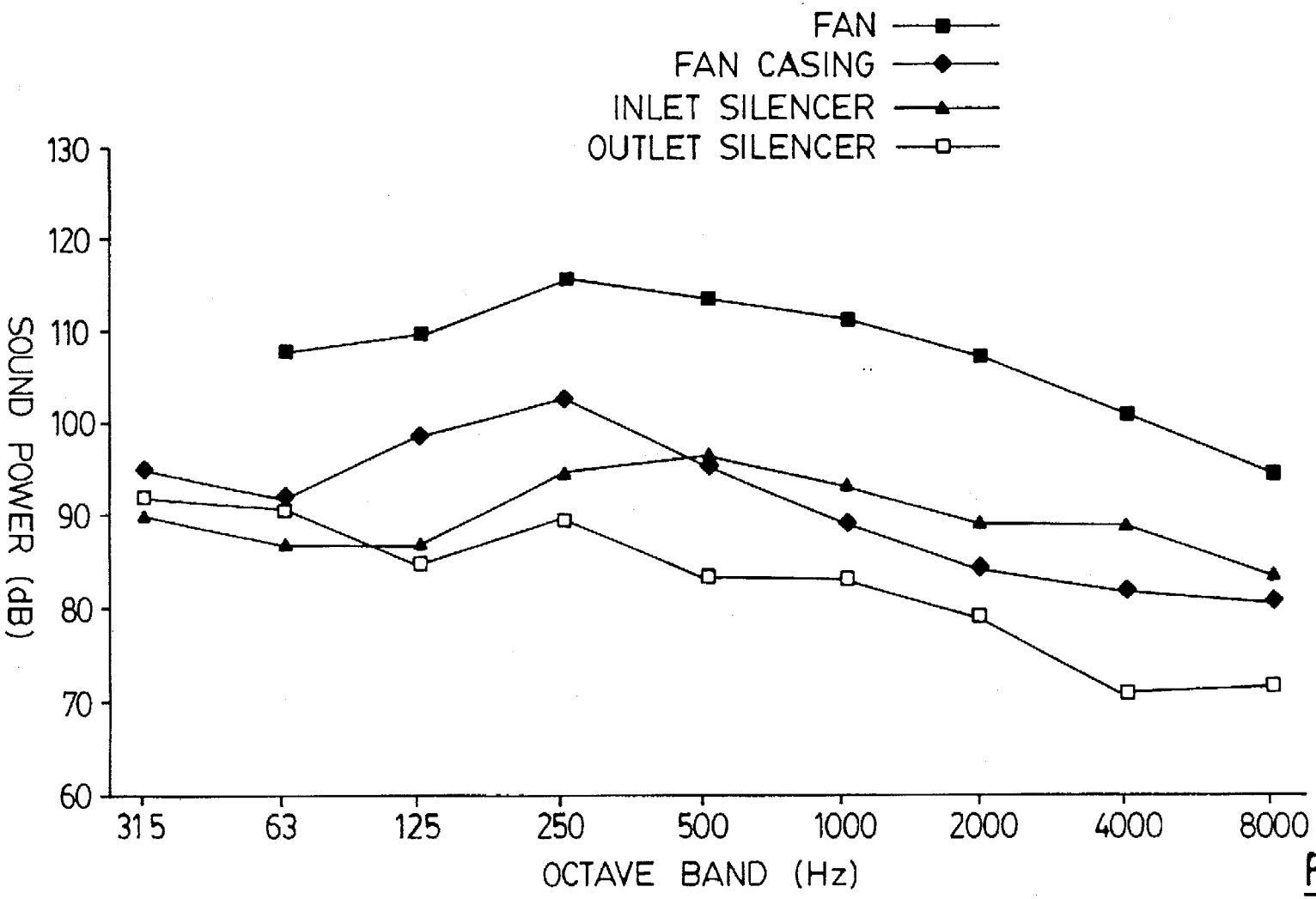
FIG. 12 is a graph plotting sound power (dB) against the octave band (Hz) and showing the results of tests conducted with an inlet silencer and outlet silencer constructed in the manner described herein.

FIG. 12 is a graph which plots sound power against octave bands. This graph is a plot of the test results listed in the above Table 1.

It will be understood by one skilled in this art that the type of duct structure shown in FIG. 6 with two series of splitters can also be used to construct an inlet duct apparatus/silencer. If such an inlet duct/silencer is constructed, it will be understood that the splitters are modified so that they converge from the air inlet of the air duct unit towards the fan and the round nose of each splitter is arranged on the upstream side in the air flow passageway, the pointed end being at the downstream side. A diffusing baffle member is not required in an inlet duct silencer of this type.

It will be further appreciated by those skilled in the art that an outlet duct silencer similar to the inlet duct silencer of FIGS. 2 and 3 could be constructed if desired, that is in this type of outlet duct silencer the air passageways would extend through a substantial curve, for example, 90 degrees. There can be a single passageway curving in one direction or two air flow passageways curving in two opposite directions. The splitters used in this outlet duct silencer would have a circular quadrant shape.

As illustrated in FIGS. 2 and 3, in a preferred embodiment the interior wall 52 is fitted with a projecting extension member 192 which is wedge shaped as shown. This can be made of imperforate 16 gauge sheet metal and, in one embodiment, it has a horizontal length of 18 inches. This extension can be located within adjacent coil mounting frames which are part of air conditioning units indicated at 194 and 196 in FIG. 1.

The advantages of the applicant's improved duct inlet apparatus and duct outlet apparatus will be apparent from the above detailed description. They have very good sound attenuation characteristics for both high frequency and low frequency sounds. The splitters or dividers in the inlet and outlet sound attenuating apparatus also provide for a uniform or even airflow within the airflow passageway. In case of the duct inlet apparatus 20, the use of both vertical and horizontal splitters or dividers helps to assure that each section of the fan inlet gets an equal amount of air. The outlet 46 of the apparatus 20 is divided into equal areas by solid metal dividers. The apparatus 20 provides a shallow bell arrangement with a large turning radius for the air flow. The apparatus 20 has advantages over the use of a deep bell construction which could cause pressure losses, flow separation and unequal flow distribution. In some cases, the use of a deep bell in this situation could even cause the fan to stall.

It will be apparent to one skilled in the construction of air supply units and systems that various modifications and changes could be made to the above described air supply duct apparatus without departing from the spirit and scope of this invention. Accordingly, all such modifications and changes as fall within the scope of the appended claims are intended to be part of this invention.

We therefore claim:

1. A sound attenuating duct unit for placement at an outlet of an air supply fan unit for a building or other large structure, said duct unit comprising an exterior housing having a number of sides and formed by exterior sidewalls, internal walls mounted in said housing and defining a substantially curved, main airflow passageway, a circular air inlet for said passageway in one of said sides of the housing for arrangement next to an outlet of said fan unit, said one side of the housing being located on the housing opposite one of said exterior sidewalls, and a rectangular air outlet for said passageway in another of said sides of said housing, said another side extending at a substantial angle to said one side, said internal walls providing a gradual transition in the transverse cross-section of the main airflow passageway from circular to rectangular, said main airflow passageway extending only from said circular air inlet to said rectangular air outlet, sound absorbing material arranged between said internal walls and said exterior sidewalls of the housing and surrounding said airflow passageway, and splitter apparatus mounted in said main airflow passageway and extending from one side of said passageway to an opposite side thereof, said splitter apparatus splitting said main airflow passageway into smaller passageways, wherein air flow through all of said smaller passageways leaves said duct unit through said rectangular air outlet during use of said duct unit.

2. A sound attenuating duct unit according to claim 1 wherein said another side extends at an angle of about 90 degrees to said one side.

3. A sound attenuating duct unit according to claim 1 including resonator means for reducing noise created by operation of said fan unit, said resonator means having a hollow resonator chamber located adjacent said air inlet, said chamber being enclosed by chamber walls including a peripheral wall perforated with a number of holes and facing said main airflow passageway.

4. A sound attenuating duct unit according to claim 1 including a central airflow defining member rigidly mounted in said housing, said member extending to said inlet so that said airflow passageway is annular at said inlet.

5. A sound attenuating duct unit according to claim 2 wherein said splitter apparatus comprises air stream splitters of different sizes that are rigidly mounted in said housing.

6. A sound attenuating duct unit according to claim 5 including a central airflow defining member rigidly mounted in said housing, said member extending to said inlet so that said airflow passageway is annular at said inlet.

7. A sound attenuating duct unit according to claim 6 wherein each splitter contains sound attenuating material and has at least a substantial portion of its exterior formed with perforated sheet metal.

8. A sound attenuating duct unit according to claim 5 wherein said splitters are also curved so as to follow the curve in the airflow passageway.

9. A sound attenuating duct unit according to claim 1 wherein said splitter apparatus comprises air stream splitters of different sizes that are rigidly mounted in said housing and that are curved so as to follow the curve in the airflow passageway, said splitters containing sound attenuating material.

10. A sound attenuating duct unit for placement at an outlet of an air supply fan unit comprising:

an exterior housing having a number of sides formed by exterior walls of said housing, an air inlet with a circular outer perimeter in one of said sides that lies in a first plane, and a rectangular air outlet in another of said sides that lies in a second plane arranged at a substantial angle to said first plane, said air inlet being adapted for connection to the fan unit in order to receive airflow from the fan unit, said one side of the housing being located on the housing opposite one of said exterior walls;

interior walls arranged in said housing and defining longitudinal sides of a main airflow passageway which is substantially curved in its lengthwise direction and which extends lengthwise from said air inlet to said air outlet, said interior walls providing a gradual transition in the transverse cross-section of said airflow passageway from circular to rectangular, said main airflow passageway extending only from said air inlet to said rectangular air outlet;

sound absorbing material arranged between said interior walls and said exterior walls and covering said longitudinal sides of said main airflow passageway; and splitter apparatus rigidly mounted in said airflow passageway and extending transversely from one longitudinal side of said passageway to an opposite longitudinal side thereof, said splitter apparatus dividing said main airflow passageway into smaller passageways wherein air flow through all of said smaller passageways exits said duct unit through said rectangular air outlet during use of said duct unit.

11. A sound attenuating duct unit according to claim 10 wherein said second plane is arranged at an angle of about 90 degrees to said first plane.

12. A sound attenuating duct unit according to claim 11 including a hollow resonator chamber located adjacent said air inlet and capable of reducing noise created by operation of said fan unit, said chamber being enclosed by chamber walls including a peripheral wall perforated with a number of holes and facing said main airflow passageway.

13. A sound attenuating duct unit according to claim 10 wherein said splitter apparatus comprising air stream splitters of different sizes with each splitter containing sound attenuating material.

14. A sound attenuating duct unit according to claim 13 wherein said interior walls are formed at least in part with perforated sheet metal.

15. A sound attenuating duct unit according to claim 14 wherein at least substantial portions of said splitters are formed with perforated sheet metal.

16. A sound attenuating duct unit according to claim 14 including a central airflow defining member rigidly mounted in said housing, said member extending to said air inlet so that said main airflow passageway is annular at said inlet.

17. A sound attenuating duct according to claim 16 wherein said central airflow defining member is filled with sound absorbing material.

18. A sound attenuating duct unit according to claim 10 wherein said splitter apparatus includes airstream splitters which are curved so as to follow the curve in the airflow passageway.

19. A sound attenuating duct unit according to claim 15 wherein at least some of said splitters have nose portions which are semi-circular in horizontal cross-section.

20. A sound attenuating duct unit according to claim 19 wherein said splitters have streamlined exterior walls with tapering tail sections that taper to a straight edge.

21. A sound attenuating duct unit according to claim 11 wherein said splitter apparatus comprises air stream splitters of different sizes with each splitter containing sound attenuating material.

22. A sound attenuating duct unit according to claim 21 wherein said interior walls are formed at least in part with perforated sheet metal and at least substantial portions of said splitters are formed with perforated sheet metal.

23. A sound attenuating duct unit suitable for placement adjacent an air supply fan unit for a building or other large structure, said duct unit comprising:

an exterior housing having a number of sides including sides formed by top, bottom and end walls of said housing, an annular opening in one end wall of said housing for arrangement next to one end of said fan unit, said one end wall lying in a first plane and being located opposite another end wall of the housing, said annular opening having a central axis extending perpendicular to said one end wall, two rectangular openings located on two opposite sides of said housing, said two opposite sides each extending at a substantial angle to said first plane; and interior walls arranged in said housing, connected to said top, bottom and end walls, and defining two primary airflow passageways each of which is substantially curved in an axial plane extending through said central axis and substantially perpendicular to said two opposite sides, said annular opening and rectangular openings being connected by said primary airflow passageways so that the airflow through said annular opening flows through said rectangular openings, and splitter apparatus mounted in each of said airflow passageways and splitting said primary passageways into smaller passageways, wherein said primary airflow passageways extend only from said annular opening to said two rectangular openings, airflow through all of said smaller passageways exits said duct unit through said two rectangular openings during use thereof, and sound absorbing material is arranged between internal walls and said walls of the housing and surrounds said airflow passageways.

24. A sound attenuating duct unit suitable for placement adjacent an air supply fan unit for a building or other large structure, said duct unit comprising:

an exterior housing having a number of sides including sides formed by top, bottom and end walls of said housing, an annular opening in one end wall of said housing for arrangement next to one end of said fan unit, said one end wall lying in a first plane, said annular opening having a central axis extending perpendicular to said one end wall, two rectangular openings located on two opposite sides of said housing, said two opposite sides each extending at a substantial angle to said first plane; and interior walls arranged in said housing connected to said top, bottom and end walls and defining airflow passageways each of which is substantially curved in an axial plane extending through said central axis and substantially perpendicular to said two opposite sides, said annular opening and rectangular openings being connected by said airflow passageways so that the airflow through said annular opening flows through said rectangular openings, resonator means for reducing noise created by operation of said fan unit comprising a hollow resonator chamber located adjacent said annular opening, said chamber being enclosed by chamber walls including a peripheral wall perforated with a number of holes and facing the airflow passageway at said annular opening, wherein sound absorbing material is arranged between said internal walls and said walls of the housing and surrounds said airflow passageways.

25. A sound attenuating duct unit according to claim 24 including a central airflow defining member rigidly mounted in said housing and extending into the housing from the center of said annular opening, said airflow defining member having an exterior formed of perforated metal plate and containing sound absorbing material.

26. A sound attenuating duct unit according to claim 24 wherein one of said interior walls forms an annulus which is semi-circular in cross-section, said one interior wall being made of perforated sheet metal.

27. A sound attenuating duct unit according to claim 24 wherein at least one of said interior walls is shaped like one half of a funnel divided along a central axial plane, said at least one interior wall extending from said annular opening to one of said rectangular openings.

28. A sound attenuating duct unit according to claim 27 wherein said at least one interior wall has one side thereof made of perforated metal sheet and contains sound absorbing material.

29. A sound attenuating duct unit for placement at an outlet of an air supply fan unit comprising:

an exterior housing having a number of sides formed by exterior walls of said housing, an air inlet with a circular outer perimeter in one of said sides that lies in a first plane, and a rectangular air outlet in another of said sides that lies in a second plane arranged at a substantial angle to said first plane, said air inlet being adapted for connection to the fan unit in order to receive airflow from the fan unit;

interior walls arranged in said housing and defining longitudinal sides of a main airflow passageway which is substantially curved in its lengthwise direction and which extends lengthwise from said air inlet to said air outlet, said interior walls providing a gradual transition in the transverse cross-section of said airflow passageway from circular to rectangular;

a hollow resonator chamber located adjacent said air inlet and capable of reducing noise created by operation of said fan unit, said chamber being enclosed by chamber walls including a peripheral wall perforated with a number of holes and facing said main airflow passageway;

sound absorbing material arranged between said interior walls and said exterior walls and covering said longitudinal sides of said main airflow passageway; and splitter apparatus rigidly mounted in said airflow passageway and extending transversely from one longitudinal side of said passageway to an opposite longitudinal side thereof, said splitter apparatus dividing said main airflow passageway into smaller passageways.

30. A sound attenuating duct unit according to claim 29 wherein said second plane is arranged at an angle of about 90 degrees to said first plane.

* * * * *